United States Patent [19]

Harhoff et al.

[11] 4,173,421

[45] Nov. 6, 1979

[54] SHIELD APPARATUS FOR USE IN TUNNELLING OR MINING

[75] Inventors: Karl Harhoff; Heinz Hüsemann, both of Werne, Fed. Rep. of Germany

[73] Assignee: Gewerkschaft Eisenhutte Westfalia, Lunen, Fed. Rep. of Germany

[21] Appl. No.: 840,447

[22] Filed: Oct. 7, 1977

[30] Foreign Application Priority Data

Oct. 15, 1976 [DE] Fed. Rep. of Germany ..... 2646552

[51] Int. Cl.[2] ..... E21D 19/00

[52] U.S. Cl. ..... 405/291; 405/288

[58] Field of Search ..... 61/45 R, 45 C, 84, 85, 61/42; 299/31, 33

[56] References Cited

U.S. PATENT DOCUMENTS

| | | | |
|---|---|---|---|
| 3,800,549 | 4/1974 | Lobbe | 61/85 |
| 3,812,680 | 5/1974 | Walbrohl | 61/45 C |
| 3,903,707 | 9/1975 | Foik | 61/85 |
| 3,998,067 | 12/1976 | Fernandez | 61/85 |

FOREIGN PATENT DOCUMENTS

| | | | |
|---|---|---|---|
| 1227317 | 4/1971 | United Kingdom | 61/45 C |

*Primary Examiner*—Dennis L. Taylor

*Attorney, Agent, or Firm*—Sughrue, Rothwell, Mion, Zinn and Macpeak

[57] ABSTRACT

Shield apparatus for use in tunnelling or mining employs two spaced-apart arcuate frames each composed of a pair of segmental components interconnected at the roof by means of telescopic guides and a central pivot joint. The roof pivot joint between the components of each frame is disposed inside a hollow support and hydraulic rams connect the components to the support. At their lower ends the components of each frame are supported on floor structures connected together with a floor beam. Pivot joints are again formed between the floor structures and the frame components and further telescopic guides and hydraulic rams are arranged between the frame components and the floor structures. The frame components, which may support elongate drive members on their exterior, are adjustable with the aid of the hydraulic rams about the pivot joints to expand or contract the frames.

5 Claims, 5 Drawing Figures

SHIELD APPARATUS FOR USE IN TUNNELLING OR MINING

BACKGROUND TO THE INVENTION

The present invention relates to shield apparatus, especially for use in driving tunnels or similar excavations underground or for use in mine workings.

Drive shields are known which employ one or more frames supporting a plurality of displaceable drive members which contact the wall of a tunnel. The drive members are advanced individually or in groups by means of hydraulic rams. It is also known to construct the frames of shield apparatus so that they can be expanded to brace against the wall of the tunnel. In German patent specification No. 2314703 for example, a shield is described which has drive members or cutters supported and guided on frames which are composed of two components pivotably interconnected at the roof and carried by hydraulic props. The frame components are also connected together at the floor by means of a beam which can be varied in length by means of piston and cylinder units. Another type of shield apparatus is described in German Patent specification No. 2021734. In this shield apparatus, the frames carrying the drive members are extendible or retractible so that in the retracted or contracted position the frames can be easily advanced while in the extended or expanded position they brace the shield and urge the drive members primarily against the roof of the tunnel wall. To provide for the expansion and contraction of the frames, these frames are composed of components connected together through expansion devices in the form of hydraulic piston and cylinder units.

In the known shield apparatuses which utilize expandible frames it is sometimes difficult to ensure stability and during operation pivot joints and the expansion devices can sometimes by subjected to unduly high transverse bending forces which can cause damage.

A general object of the present invention is to provide an improved shield apparatus.

SUMMARY OF THE INVENTION

In a shield apparatus which has at least one frame and means for expanding or contracting the frame the invention can be realized by constructing the frame from separate components interconnected by means of at least one telescopic guide additional to the expanding means and comprising an inner part freely slidable inside an outer part.

In another aspect of the invention shield apparatus comprises frame components, means for displacing said components in relation to a wall of the tunnel and at least one separate telescopic guide interconnecting said frame components.

In one preferred embodiment of the invention the shield apparatus comprises at least one frame composed of similar arcuate components, an upper support defining a roof pivot joint, telescopic guide means connecting each of said components to the roof pivot joint, hydraulic ram means connecting the components to the upper support, at least one floor support, floor pivot joints, telescopic guide means connecting each of said components to the floor support to include the floor pivot joint and hydraulic ram means connecting the components to the floor support whereby the ram means are operable to expand or contract the frame components about the roof and floor pivot joints.

Preferably, the shield apparatus has two spaced apart frames each composed of frame components as described. The frame components can be arcuate hollow bodies connected through telescopic guides to a roof coupling permitting relative pivoting between the components. Expansion devices, e.g., piston and cylinder units, may also be associated with this roof coupling. Preferably, the forces exerted by the expansion devices are directed parallel to the axes of the guides and also preferably perpendicularly to the roof pivot axis. The expansion forces and the line of action of the guides are advantageously approximately tangential to the shield itself.

Each frame component can also be connected through another telescopic guide to a floor coupling which incorporates a further pivot joint. The frame components can then pivot about three symmetrical parallel pivot axes one of which lies at the roof and the others of which lie at the floor. It is generally desirable to position the telescopic guides as close as possible to the pivot axes.

In general it is also desirabe to have a pair of hydraulic piston and cylinder units symmetrically disposed at the sides of each telescopic guide.

The roof pivot joint can be arranged inside a hollow support with the telescopic guides linking the frame components directly to the pivot joint and the expansion devices can link the frame components to the support. The frame components can be connected through telescopic guides and expansion devices to individual floor structures which are themselves interconnected via a floor beam and combination of piston and cylinder units and further telescopic guides.

The frame components can bear on the wall of the tunnel or other excavation or, as is more usual, the frame components preferably support displaceable drive members.

Shield apparatus made in accordance with the invention enables the pivot joints and the expansion devices to be largely protected from damaging bending forces and relative rotatability between the parts of the telescopic guides is particularly useful in protecting the guides themselves.

BRIEF DESCRIPTION OF DRAWINGS

An embodiment of the invention, will now be described, by way of example only, with reference to the accompanying drawings, wherein.

DESCRIPTION OF PREFERRED EMBODIMENT

Figure 3:
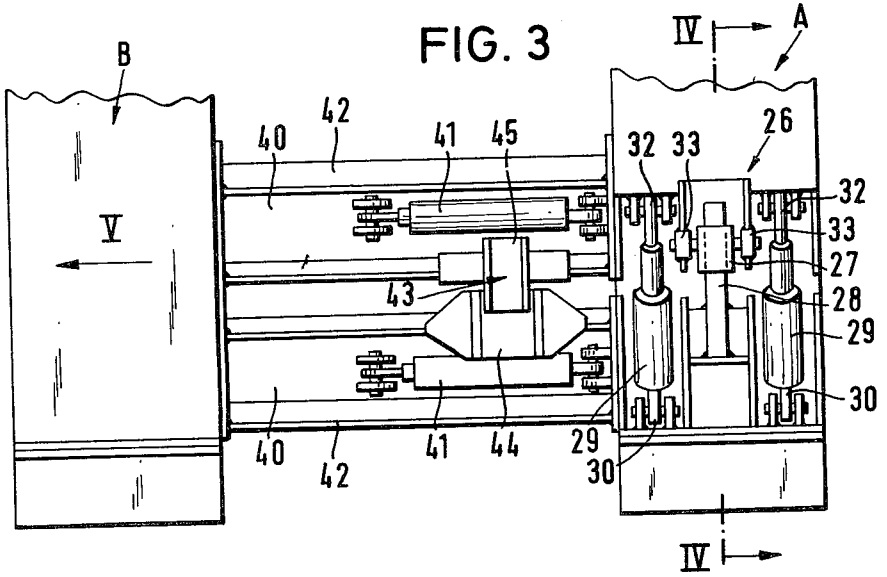
FIG. 3 is an inner side view of part of the apparatus taken in the direction of arrow III in FIG. 1.

As shown in the drawings, shield apparatus made in accordance with the invention is overall of part cylindrical configuration with a domed profile and is here formed as a drive or cutter shield for supporting the roof of an excavation underground. The apparatus can be used in driving roadways or tunnels in loose material or in hard material such as rock or in underground mine workings. The apparatus employs two frames, denoted A and B in FIG. 3, which are spaced apart along the working and interconnected with the aid of struts 42. Each frame A, B is designed to be expandible as described hereinafter. In FIG. 3, the frame B is only shown diagrammatically but it can be assumed that this frame B is constructed in a similar manner to the frame A as described hereinafter. A plurality of drive members or cutters 40 are displaceably guided on the frames A, B and hydraulic rams 41 (FIG. 3) are used to advance the drive members 40 individually or in groups in the driving direction (V in FIG. 3). The rams 41 are supported on the frame A and the frames A, B can be drawn up from time to time by operating the rams 41 in unison.

To enable the frames A, B to form a strong abutment for the forces exerted by the rams 41 when the drive members 40 are driven forwards, the frames A, B may have claws or the like which penetrate the wall of the working. It is also possible to provide control devices which can press against the wall or against the roof or floor to control the direction of advancement of the shield.

Figure 2:
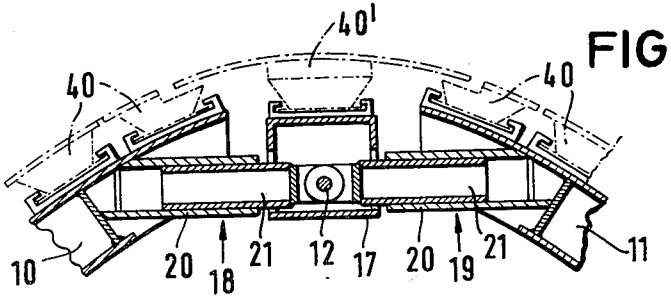
FIG. 2 is a detail part-sectional end view of an upper region of the apparatus, the view being taken on a somewhat larger scale than FIG. 1.

The frame A employs two symmetrical curvilinear components or segments 10, 11 which are pivotably interconnected at the upper zone with a roof or ridge coupling depicted in detail in FIG. 2. The lower zone of each component 10, 11, is pivotably connected to a hollow boxlike floor structure 14, 15 respectively, with the aid of a foot or floor coupling depicted in detail in FIGS. 3 to 5. Each component 10, 11 is of hollow boxlike construction stiffened and reinforced by longitudinal and lateral inside webs. The floor structures 14, 15 are symmetrical and are connected together to resist lateral tension with the aid of a floor girder or beam 16.

Figure 1:
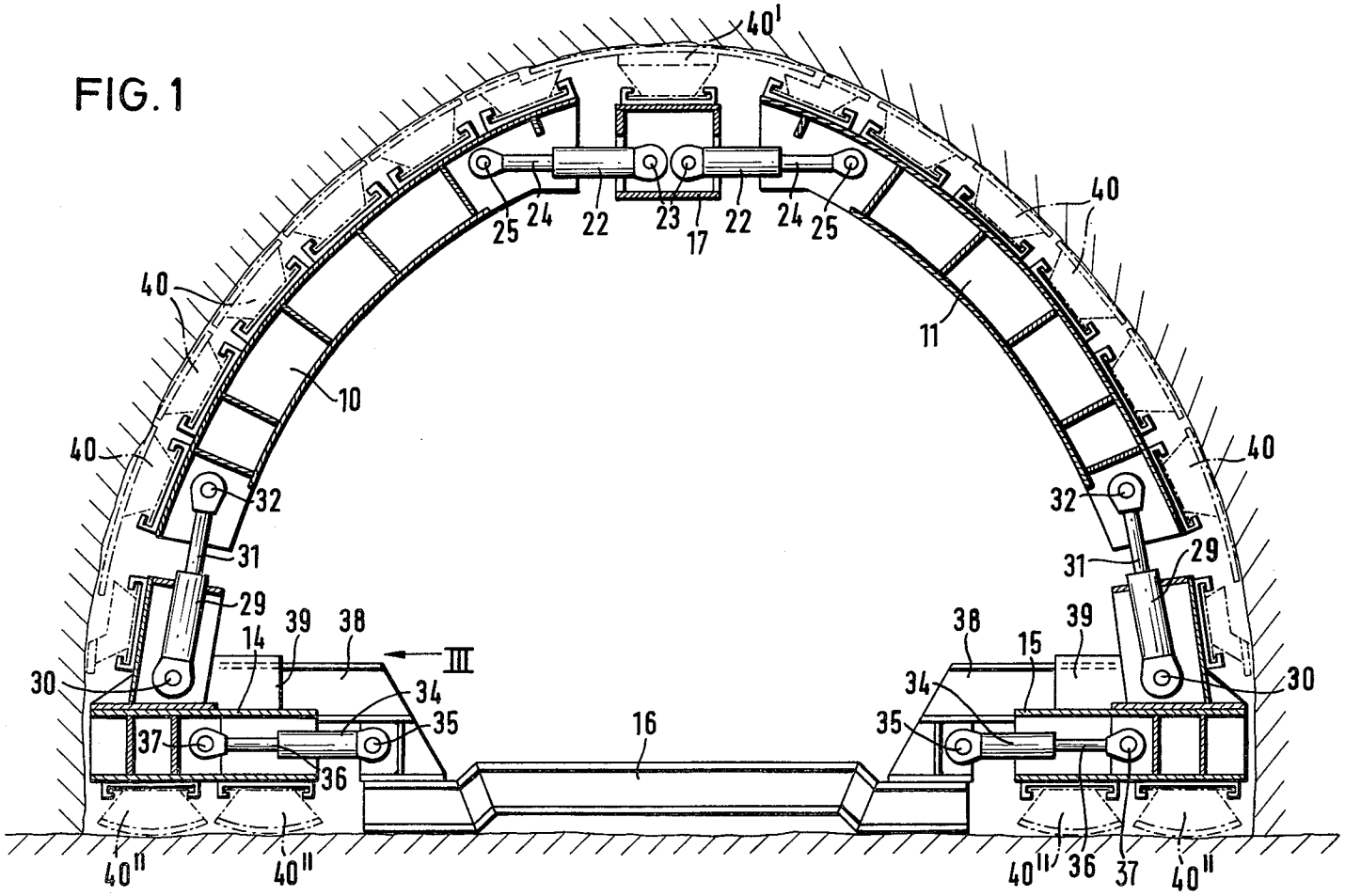
FIG. 1 is a schematic part-sectional end view of shield apparatus made in accordance with the invention.

As shown in FIG. 2, the roof or ridge coupling joining the components 10, 11 together has a pivot joint 12 formed inside a hollow beam-like support 17. Two telescopic guides 18, 19 are linked to the components 10, 11 respectively and extend into the support 17 through apertured side walls thereof to connect with the joint 12. Each guide 18, 19 is composed of an outer hollow part 20 rigidly secured to the respective components 10, 11 and an inner part 21 slidably displaceable with respect to the outer part 20 and pivotably connected to the joint 12. The roof coupling is associated with an expansion device which is shown in FIG. 1. The expansion device is composed of piston and cylinder units 22 which are preferably arranged in sets at both sides of the guide members 18, 19. The units 22 of each set are co-linear and extend through apertures in the side walls of the support 17. The cylinder of each unit 22 is pivotably connected to the support 17 with the aid of a pivot joint or pin 23 while the piston rod 24 of each unit 22 is pivotably connected to the respective component 10, 11 via a pivot joint or pin 25. The complete ridge coupling with the support 17, the guide members 18, 19 and the expansion device (22) is symmetrical with the force exerted by the units 22 directed parallel to the guide members 18, 19 and perpendicular to the joint 12.

Figure 4:
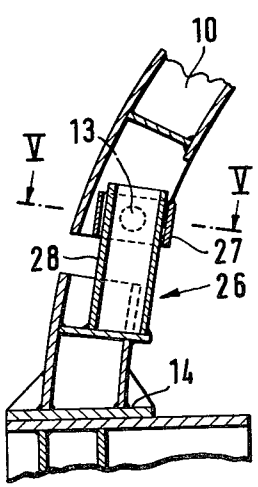
FIG. 4 is a sectional end view of part of the apparatus, the view being taken along the line IV—IV of FIG. 3.
Figure 5:
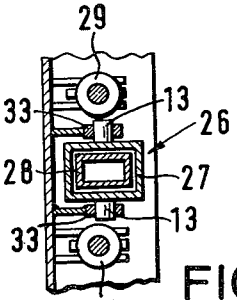
FIG. 5 is a sectional plan view of part of the apparatus the view being taken along the line V—V of FIG. 4.

The floor or foot couplings linking the floor structures 14, 15 to the components 10, 11 can employ telescopic guides of generally similar construction to the ridge coupling. Thus, as shown in FIGS. 3 to 5 each foot coupling has a telescopic guide 26 with an outer hollow part 27 and an inner part 28. The inner part 28 is rigidly secured to the floor structure 14, 15 while the outer part 27 is pivotably connected to the component 10, 11 with the aid of a pivot joint 13. This pivot joint 13 is composed of spigots or journals secured to the part 27 of the guide 26 and engaging in bores of a support or bearing pieces 33 (FIG. 3) secured to the component 10, 11. Each floor or foot coupling is also associated with an expansion device composed of piston and cylinder units 29 (FIG. 3) mounted at either side of the guide 26 thereof. The cylinders of each pair of units 29 are connected with pivot joints 30 to the floor structure 14, 15 while the piston rods 31 of the units 29 are connected with pivot joints 32 to the lower end of the component 10, 11. The outer parts 27 of the guides 26 lie protected inside the components 10, 11 and the units 29 with their pivot joints 30, 32 lie protected partly in the components 10, 11 and partly in the floor structures 14, 15. The forces exerted by the units 29 are directed parallel to the associated guide member 26 and perpendicularly to the joint 13.

The force exerted by each of the units 22, 29 extends approximately tangentially to a circle describing the components 10, 11. In general, the units 22, 29 can be operated to expand or contract the shield in an approximate radial sense, i.e., against or away from the wall of the excavation or working. When the units 22, 29 are operated the guides 18, 19, 26 extend or retract and stabilize the shield. The overall design as described ensures that load forces transferred from the wall of the excavation or working to the shield can be taken up by the units 22, 29 and the guides 18, 19, 26 in a manner whereby the guides 18, 19, 26, the units 22, 29 and the pivot joints 12, 13 are all protected from transverse flexure forces. Thus, bending or damage of these components can be largely avoided.

As shown in FIG. 1, the floor structures 14, 15 are connected to the beam 16 by means of piston and cylinder units 34 which effect transverse adjustment. The cylinders of these units 34 are connected with pivot joints 35 to the beam 16 while the piston rod, 36 of the units 34 are connected to the floor structures 14, 15 with pivot joints 37. Guides are also provided between the beam 16 and the floor structures 14, 15. The guides are again telescopic with inner parts 38 rigidly mounted to the ends of the beam 16 and displaceably engaging into outer parts 39 fixed to the floor structures 14, 15. This arrangement, depicted clearly in FIG. 1, again ensures that the guides 38, 39 are only subjected to minimal bending forces.

As mentioned previously, the exterior of the components 10, 11 of the frames A, B guide and support displaceable drive members 40 arranged side-by-side.

As shown in FIG. 1, the support 17 also carries a similarly-displaceable drive member 40' which lies at the top of the shield apparatus. The drive member 40' is widened in relation to the other drive members 40 and engages as with a tongue-and-groove connection with adjacent drive members 40 to close off the gap therebetween. The undersides of the floor structures 14, 15 also guide displaceable drive members 40'' resting on the floor of the working. As with the drive members 40, the drive members 40', 40'', are shifted with the aid of rams 41 and preferably individually.

To ensure that the various telescopic guides are not subjected to excessive force when the frames A and B are shifted up the struts 42 carry a guide device 43 which as shown in FIG. 3, comprises a projection block 45 engaging in a slidable guide piece 44.

It is not essential to provide the drive members 40, 40', 40'' and the frames A, B can be adapted to directly engage the wall of the excavation. The shape of the frames A, B can also be modified if desired, e.g., ovular or polygonal configurations are practicable.

We claim:

1. In a shield apparatus for driving tunnels or the like comprising two axially spaced apart support frames each of generally arch-shaped configuration, drive members supported on the outer sides of the frames, the drive members extending in the axial direction, and means for shifting one frame relative to the next in the axial direction, the improvement comprising support frames each assembled from:

two transversely spaced apart floor components, a ridge component, two transversely spaced apart outwardly arcuate side components, each side component having upper and lower ends, the upper end thereof being adjacent a respective side of the ridge component, the lower end thereof being disposed above a respective one of the floor components, a pair of first telescopic guide means, each comprising a first member rigid with one of the floor components and a second member pivoted to the associated side component about an axis extending axially of the apparatus, a pair of second telescopic guide means, each comprising a member rigid with a respective side component and a member pivoted to the ridge component about an axis extending axially of the apparatus, a pair of first hydraulic ram means, each acting between the ridge means and a respective side component, and said arcuate side components being supported solely at said upper and lower ends.

2. An apparatus as claimed in claim 1, wherein a floor beam is disposed between the floor components and third hydraulic ram means are arranged to act between each of the floor components and the floor beam.

3. An apparatus as claimed in claim 1, wherein the ridge component is constituted by a hollow axially extending beam and the second guide means and second hydraulic ram means extend through apertures in the sides of said beams.

4. An apparatus as claimed in claim 1, wherein the guides include a box-shaped tubular guide member.

5. In a shield apparatus for driving tunnels or the like comprising two axially spaced apart support frames, each of generally arch-shaped configuration, drive members supported on the outer side of the frames, the drive members extending in the axial direction, and means for shifting one frame relative to the next in the axial direction, the improvement comprising support frames each of which is self-supporting whereby the space within the frame is wholly unobstructed, each frame comprising a ridge component, a pair of arcuate side components and at least one floor component, the ridge and side components being connected by telescopic guides each having one member rigid with one of the ridge components and a respective side component and another member pivoted to the other such component, each side component being supported from the at least one floor component by a respective telescopic guide having one member rigid with one of the side components and at least one floor component and another member pivoted to the other such component, and hydraulic ram means for adjusting the height of the side components relative to the at least one floor component and relative to the ridge component.

* * * * *